US007035567B2

(12) United States Patent
Gila et al.

(10) Patent No.: US 7,035,567 B2
(45) Date of Patent: Apr. 25, 2006

(54) APPARATUS AND METHOD FOR REDUCING CONTAMINATION OF AN IMAGE TRANSFER DEVICE

(75) Inventors: Omer Gila, Cupertino, CA (US); Michael H. Lee, San Jose, CA (US); Seongsik Chang, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 14 days.

(21) Appl. No.: 10/902,725

(22) Filed: Jul. 29, 2004

(65) Prior Publication Data

US 2006/0024081 A1 Feb. 2, 2006

(51) Int. Cl.
*G03G 21/20* (2006.01)

(52) U.S. Cl. ..... 399/91; 399/98; 399/107

(58) Field of Classification Search ..... 399/91–93, 399/96–98, 343, 348, 355, 107
See application file for complete search history.

(56) References Cited

U.S. PATENT DOCUMENTS

| | | | | |
|---|---|---|---|---|
| 5,666,607 | A | 9/1997 | Camis | |
| 5,666,608 | A | 9/1997 | Christensen | |
| 5,852,758 | A | 12/1998 | Wibbels | |
| 5,866,284 | A | 2/1999 | Vincent | |
| 5,899,596 | A | 5/1999 | Thompson | |
| 5,946,528 | A * | 8/1999 | Cho | 399/93 |
| 5,991,589 | A | 11/1999 | Thompson et al. | |
| 6,045,955 | A | 4/2000 | Vincent | |
| 6,061,536 | A * | 5/2000 | Cho et al. | 399/92 |
| 6,243,545 | B1 | 6/2001 | Jewell | |
| 6,580,890 | B1 | 6/2003 | Phillips et al. | |
| 6,621,996 | B1 | 9/2003 | Meyer et al. | |
| 6,741,827 | B1 | 5/2004 | Lee | |

* cited by examiner

*Primary Examiner*—Hoang Ngo

(57) ABSTRACT

An apparatus and method for reducing contamination of an image transfer surface in an image transfer device includes a shield member configured to restrict airflow against the image transfer surface.

20 Claims, 3 Drawing Sheets

APPARATUS AND METHOD FOR REDUCING CONTAMINATION OF AN IMAGE TRANSFER DEVICE

BACKGROUND OF THE INVENTION

The present invention generally relates to image transfer technology and, more particularly, to an apparatus and method for reducing contamination of image transfer surfaces of an image transfer device during the printing process, and an image transfer device having the apparatus.

As used herein, the term "image transfer device" generally refers to all types of devices used for creating and/or transferring an image in a liquid electrophotographic process, including laser printers, copiers, facsimiles, and the like.

In a liquid electrophotographic (LEP) printer, the surface of a photoconducting material (i.e., a photoreceptor) is charged to a substantially uniform potential so as to sensitize the surface. An electrostatic latent image is created on the surface of the photoconducting material by selectively exposing areas of the photoconductor surface to a light image of the original document being reproduced. A difference in electrostatic charge density is created between the areas on the photoconductor surface exposed and unexposed to light. In LEP, the photoconductor surface is initially charged to approximately ±1000 Volts, with the exposed photoconductor surface discharged to approximately ±50 Volts.

The electrostatic latent image on the photoconductor surface is developed into a visible image using developer liquid, which is a mixture of solid electrostatic toners or pigments dispersed in a carrier liquid serving as a solvent (referred to herein as "imaging oil"). The carrier liquid is usually insulative. The toners are selectively attracted to the photoconductor surface either exposed or unexposed to light, depending on the relative electrostatic charges of the photoconductor surface, development electrode, and toner. The photoconductor surface may be either positively or negatively charged, and the toner system similarly may contain negatively or positively charged particles. For LEP printers, the preferred embodiment is that the photoconductor surface and toner have the same polarity.

A sheet of paper or other medium is passed close to the photoconductor surface, which may be in the form of a rotating drum or a continuous belt, transferring the toner from the photoconductor surface onto the paper in the pattern of the image developed on the photoconductor surface. The transfer of the toner may be an electrostatic transfer, as when the sheet has an electric charge opposite that of the toner, or may be a heat transfer, as when a heated transfer roller is used, or a combination of electrostatic and heat transfer. In some printer embodiments, the toner may first be transferred from the photoconductor surface to an intermediate transfer medium, and then from the intermediate transfer medium to a sheet of paper. After the toner transfer has occurred, the photoconductor surface is cleaned and recharged in preparation for the printing of a subsequent image.

Charging of the photoconductor surface may be accomplished using any of several types of charging devices, such as a corotron (a corona wire having a DC voltage and an electrostatic shield), a dicorotron (a glass covered corona wire with AC voltage, and electrostatic shield with DC voltage, and an insulating housing), a scorotron (a corotron with an added biased conducting grid), a discorotron (a dicorotron with an added biased conducting strip), a pin scorotron (a corona pin array housing a high voltage and a biased conducting grid), or a charge roller that contacts the photoconductor surface.

Each of these charging devices generate ozone ($O_3$), and nitric oxides ($NO_X$) in varying amounts, which if present in sufficient quantities, must be vented and filtered from the image transfer device. The high voltages and currents required for corona discharge devices tend to generate greater amounts of ozone and nitric oxides, while contact charging devices tend to generate smaller amounts of ozone and nitric oxides.

An active flow of air through the image transfer device may be provided to ventilate and filter ozone and/or nitric oxides from the image transfer device. In addition, an active flow of air through the image transfer device may also be provided for controlling heat build-up inside the device. In other instances, an active flow of air may be spontaneously created due to factors including high speed movement of photoconductor surface or other surfaces, and convective currents caused by heat generated within the image transfer device.

Although an active airflow through the image transfer device is sometimes required or desired for ventilation and/or cooling purposes, airflow past the photoconductor surface is problematic in long term use of the photoconductor surface. In particular, active airflow is problematic because the airflow evaporates the submicron layer of imaging oil on the photoconductor surface and entrains oil vapors present above the oil layer, thereby effectively thinning the oil layer. The remaining oil layer includes residual materials such as charge directors and other dissolved ink components that have high molecular weight and do not easily evaporate. The thinned oil layer provides reduced buffering of the molecules of residual material against ion bombardment, UV exposure and ozone penetration caused by the charging device. Therefore, the residual materials in the oil layer are more likely to react and polymerize on the photoconductor surface. Additionally, the dissolved residual material in the thinned oil layer is much closer to or beyond its solubility limit. This increases the chance for dissolved residual materials to drop out of solution and polymerize on the photoconductor surface. In the case of contact charging devices, the residual materials and polymers thereof may be forcibly pressed against the photoconductor surface, thereby increasing the amount and rate of contamination of the photoconductor surface. During the printing process, and particularly after the photoconductor surface is cleaned in preparation for a subsequent printing cycle, it is desirable that the photoconductor surface is free of residual materials from previous printing cycles, such as toner, charge directors and other dissolved materials in the imaging oil. However, effectively cleaning the photoconductor surface of all residual materials is very difficult, and some amount of residual material inevitably remains on the photoconductor surface. Due to the energy imparted by the charging device during the charging process, and the highly reactive ozone and nitric oxides generated by the charging device, over time molecules of the residual materials on the photoconductor surface react and polymerize to generate sticky materials that slowly but steadily form a film or coating on the photoconductor surface. The filming of the photoconductor surface eliminates the ability to either form latent images of small dots on the photoconductor surface, or to transfer small dots from the photoconductor surface to paper. As filming of the photoconductor surface increases over time, the print quality of subsequently printed images is reduced, and the useful life of the photoconductor surface is shortened. The filming problem is often referred to as old photoconductor syndrome (OPS). Therefore, there is a need for an apparatus or method to lessen or eliminate polymerization of the residual materials and the resulting filming of the photoconductor surface.

SUMMARY OF THE INVENTION

The invention described herein provides an apparatus and method for reducing contamination of an image transfer surface in an image transfer device. In one embodiment, the apparatus includes a shield member configured to restrict airflow against the image transfer surface.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
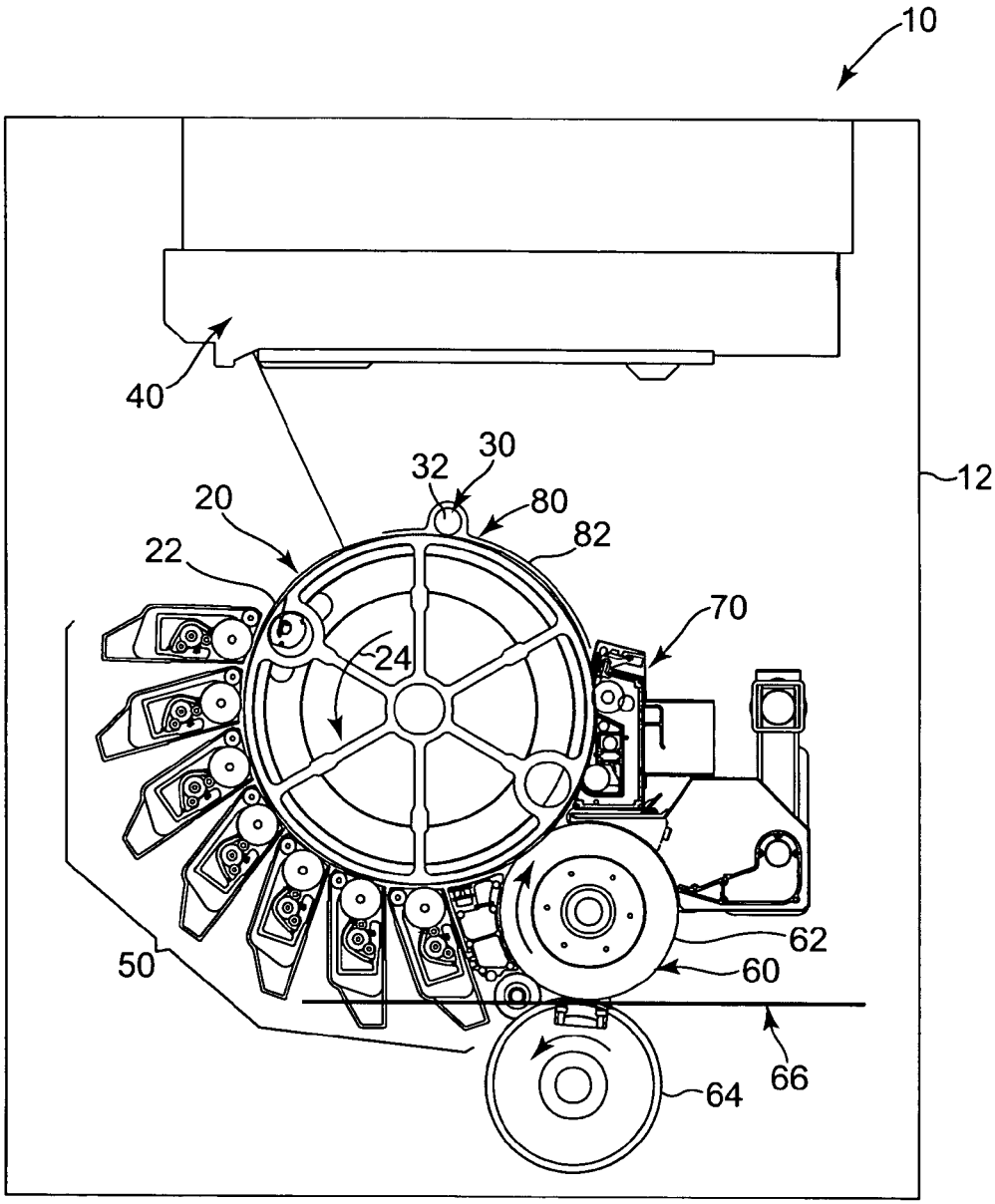
FIG. 1 is a schematic view of an exemplary image transfer device, showing a liquid electrophotographic printer having a contamination reducing apparatus according to one embodiment of the invention.

An exemplary image transfer device having an image transfer surface, specifically an LEP printer 10 having a photoconductor surface 22, is schematically shown in FIG. 1. Although, for purpose of clarity, embodiments according to the invention are illustrated herein with respect to an LEP printer having a photoconductor surface, the invention is understood to be applicable and useful with other embodiments of image transfer surfaces and image transfer devices. As illustrated, the LEP printer 10 includes a printer housing 12 having installed therein a photoconductor drum 20 having the photoconductor surface 22. Photoconductor drum 20 is rotatably mounted within printer housing 12 and rotates in the direction of arrow 24. Several additional printer components surround the photoconductor drum 20, including a charging apparatus 30, an exposure device 40, a development device 50, an image transfer apparatus 60, and a cleaning apparatus 70.

The charging apparatus 30 charges the photoconductor surface 22 on the drum 20 to a predetermined electric potential (typically ±500 to 1000 V). In some embodiments, as shown in FIG. 1, more than one charging apparatus 30 is provided adjacent the photoconductor surface 22 for incrementally increasing the electric potential of the surface 22. In other embodiments, only a single charging apparatus 30 is provided. The number of charging apparatus 30 is affected by factors including the process speed of surface 22 and the desired electric potential of the surface 22.

In one embodiment, charging apparatus 30 is a charge roller 32. During normal printing operation, charge roller 32 is in close contact with the photoconductor surface 22. A loading force is usually applied to the charge roller 32, such that the charge roller 32 is compress against photoconductor surface 22. Charge roller 32 may comprise a variety of roller designs, such as the conventional rollers known in the art. Charge roller 32 may be, for example, a conductive elastic roller having a single layer of electro-conductive rubber fixed on a metal core. Alternately, charge roller 32 may comprise a multi-layer design. Voltage is supplied to charge roller in any of various ways known in the art. The voltage may result from a DC source, an AC source, or a DC and AC source. The charge roller 32 is biased by the voltage source to a predetermined electric potential sufficient to create the desired potential on the photoconductor surface 22, for example approximately −1500 to −1000 Volts. When charging of photoconductor surface 22 begins, the photoconductor surface 22 is at an electric potential lower than the desired potential. As the photoconductor surface 22 makes contact with charge roller 32, the photoconductor surface 22 becomes charged. Although for purposes of clarity the charging apparatus 30 is illustrated herein as a charge roller, the invention is understood to be applicable and useful with other types of charging devices, particularly ionization-type charging devices used in image transfer devices.

The exposure device 40 forms an electrostatic latent image on the photoconductor surface 22 by scanning a light beam (such as a laser) according to the image to be printed onto the photoconductor surface 22. The electrostatic latent image is due to a difference in the surface potential between the exposed and unexposed portion of the photoconductor surface 22. The exposure device 40 exposes images on photoconductor surface 22 corresponding to various colors, for example, yellow (Y), magenta (M), cyan (C) and black (K), respectively.

The development device 50 supplies development liquid, which is a mixture of solid toner and imaging oil (such as Isopar), to the photoconductor surface 22 to adhere the toner to the portion of the photoconductor surface 22 where the electrostatic latent image is formed, thereby forming a visible toner image on the photoconductor surface 22. The development device 50 may supply various colors of toner corresponding to the color images exposed by the exposure device 40.

The image transfer apparatus 60 includes an intermediate transfer drum 62 in contact with the photoconductor surface 22, and a fixation or impression drum 64 in contact with the transfer drum 62. As the transfer drum 62 is brought into contact with the photoconductor surface 22, the image is transferred from the photoconductor surface 22 to the transfer drum 62. A printing sheet 66 is fed between the transfer drum 62 and the impression drum 64 to transfer the image from the transfer drum 62 to the printing sheet 66. The impression drum 64 fuses the toner image to the printing sheet 66 by the application of heat and pressure.

The cleaning apparatus 70 cleans the photoconductor surface 22 of some of the residual material using a cleaning fluid before the photoconductor surface 22 is used for printing subsequent images. In one embodiment according to the invention, the cleaning fluid is imaging oil as used by the development device 50. As the photoconductor surface 22 moves past the cleaning apparatus 70, a submicron layer of oil having residual material therein remains on the photoconductor surface 22.

Although not shown in FIG. 1, the liquid electrophotographic printer 10 further includes a printing sheet feeding device for supplying printing sheets 66 to image transfer apparatus 60, and a printing sheet ejection device for ejecting printed sheets from the printer 10.

As described above, relatively large areas of photoconductor surface 22 are commonly exposed to active air movement. The air movement may be intentionally generated, as by ventilation or cooling fans, or may spontaneously result from convective air movement inside the printer 10. Due to the airflow against the photoconductor surface 22, the submicron oil layer on the photoconductor surface 22 evaporates, such that the oil layer is thinned, and some oil vapor becomes entrained in the airflow. The photoconductor surface 22 then becomes contaminated as the residual material in the thinned oil layer reacts with the ozone, energetic ions and UV light to polymerize on the photoconductor surface 22, or drops out of solution and polymerizes on the photoconductor surface 22, as described above.

Figure 2A:
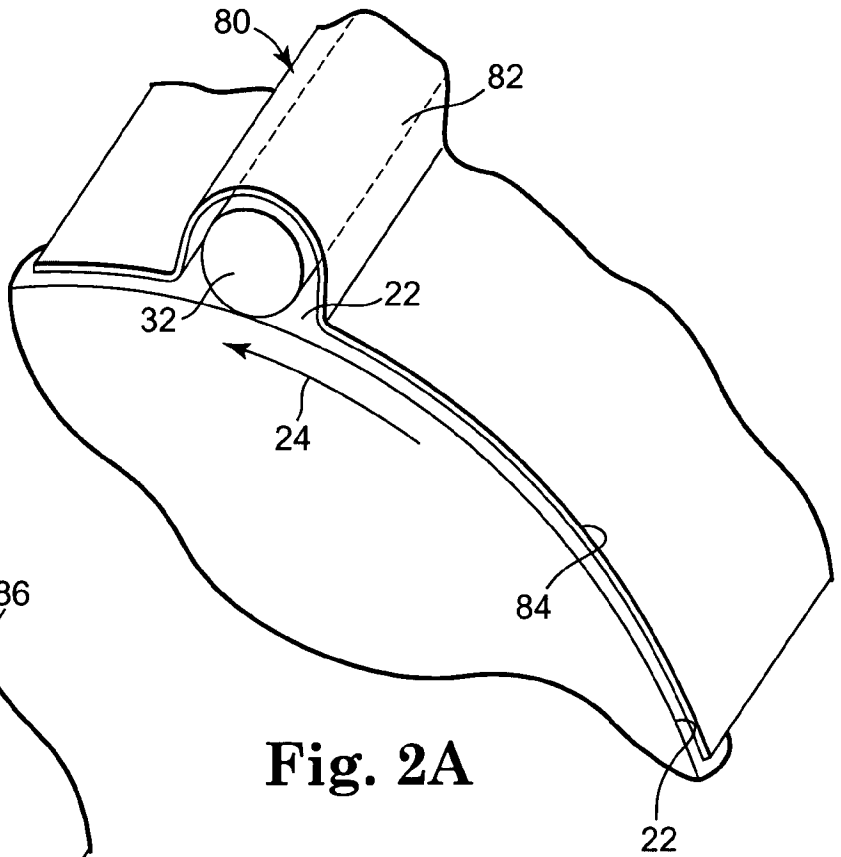
FIG. 2A is an enlarged perspective view illustrating a portion of the contamination reducing apparatus of FIG. 1.

One embodiment of a contamination reducing apparatus 80 according to the invention is schematically illustrated in FIGS. 1 and 2A. Contamination reducing apparatus 80 comprises a shield member 82 configured to closely conform to the photoconductor surface 22, such that the shield member 82 is closely spaced from photoconductor surface 22, but is not in contact with at least the portions of photoconductor surface 22 used to form an image. In one embodiment, edge portions (i.e., side edges) 84 of shield member 82 laterally extend at least to the edges of photoconductor surface 22, such that shield member 82 covers the entire width of the photoconductor surface 22, and shield member 82 is spaced from photoconductor surface 22 by a distance of at least 1 mm and preferably by a distance in the range of 2–5 mm. By maintaining the spacing between the shield member 82 and the photoconductor surface 22 in the preferred range, the partial vapor pressure of the oil immediately adjacent the oil layer is maintained, and evaporation of the oil layer is stopped or slowed. As illustrated, shield member 82 is further configured to conform to the shape of the charging apparatus 30, such that the charging apparatus 30 (charge roller 32 in the illustration) is also closely covered by the shield member 82. In other embodiments, the charging apparatus 30 need not be covered by the shield member 82. In a preferred embodiment, shield member 82 extends continuously over photoconductor surface 22 from the cleaning apparatus 70 to the charging apparatus 30, such that the oil layer on surface 22 is continuously protected or shielded from air movement in the printer 10.

Generally, it is preferred to avoid contacting photoconductor surface 22 with shield member 82 or other sealing features, such as wipers, so as to avoid damage to the imaging surface and to avoid mechanical thinning of the submicron oil layer on photoconductor surface 22. Mechanical thinning of the oil layer results in problems similar to those encountered when the oil layer is thinned by evaporation.

Figure 2B:
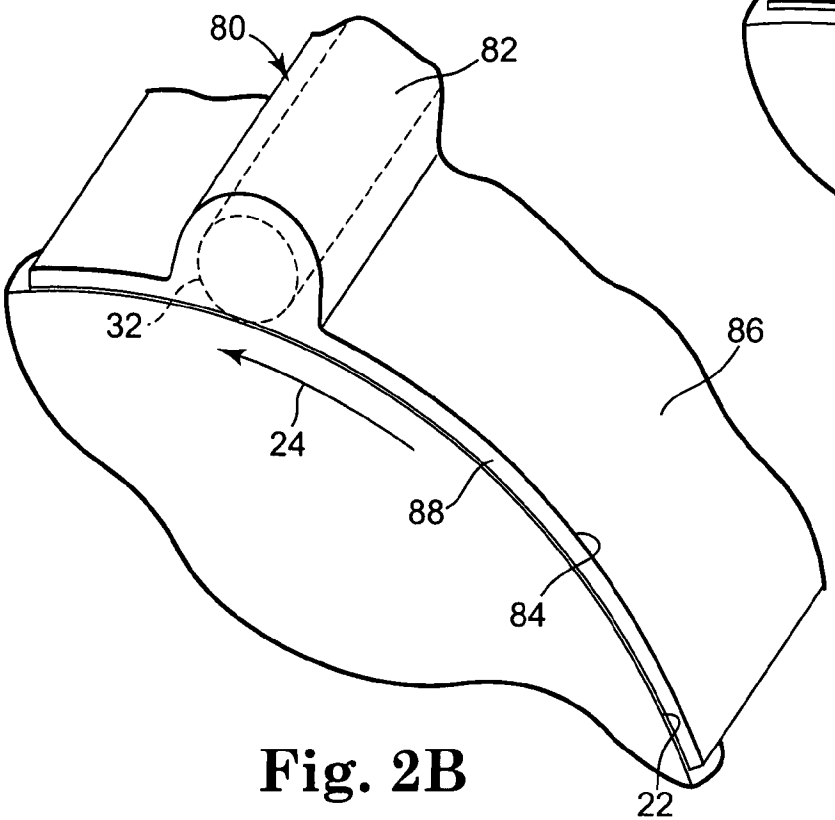
FIG. 2B is an enlarged perspective view illustrating a portion of an other embodiment of a contamination reducing apparatus according to the invention.

As shown in FIG. 2B, in some embodiments, it may be desired to form shield member 82 such that the side edges 84 of shield member 82 (i.e., the edges in parallel alignment with the direction of travel 24 of the photoconductor surface 22) are closer to photoconductor surface 22 than is the central portion 86 of shield member 82, such that air currents may be further prevented from entering the space between photoconductor surface 22 and shield member 82. In FIG. 2B, rim 88 is provided on side edges 84 and extends toward photoconductor surface 22. In one embodiment, rim 88 is brought into contact with the outside edges of photoconductor surface 22 that are not used for producing an image. In another embodiment, rim 88 extends over the sides of photoconductor surface 22.

As shown in FIGS. 1–2B, photoconductor surface 22 is shielded from an active airflow and the oil layer on the photoconductor surface is thereby protected from evaporative thinning. In addition, because ozone and nitric oxides are prevented from actively moving toward the photoconductor surface 22, the chemical exposure of the oil layer on the photoconductor surface 22 is reduced or eliminated. The reduction or elimination of evaporative thinning and chemical exposure of the oil layer on the photoconductor surface 22 reduces the amount and rate of polymerization of residual material in the oil layer, and thereby reduces filming of the photoconductor surface 22.

EXAMPLE

Figure 3:
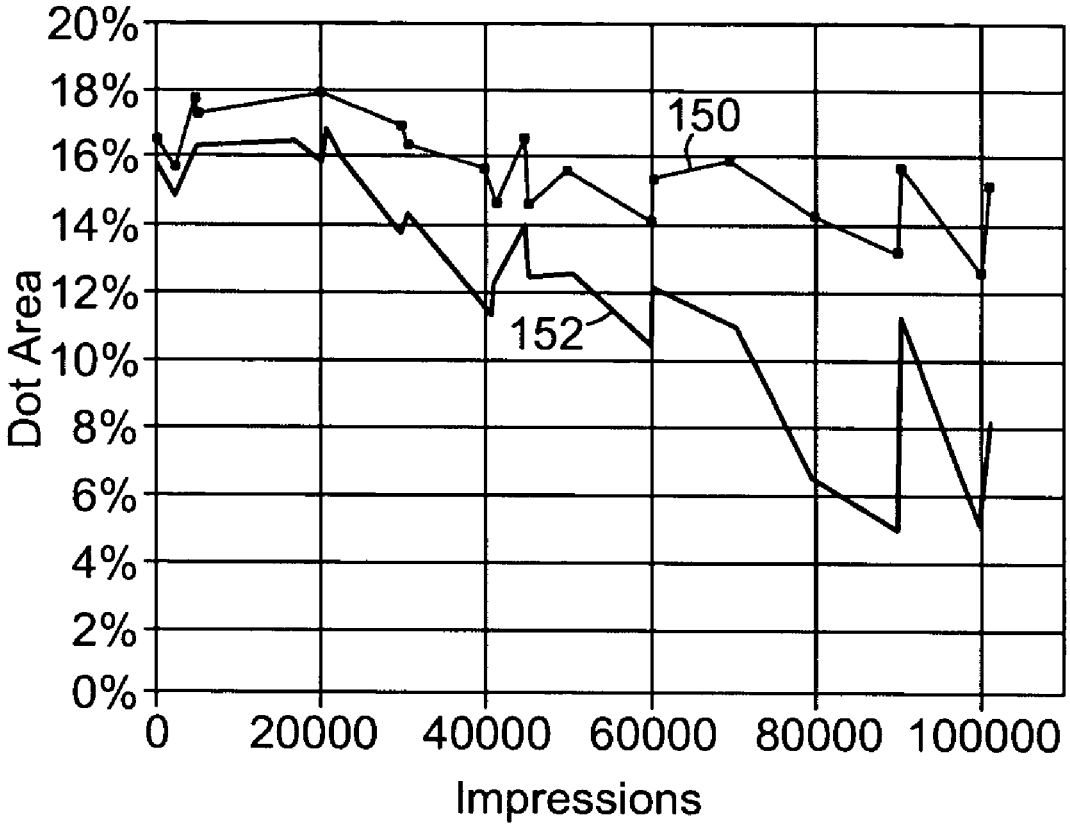
FIG. 3 is an exemplary graph illustrating the improved photoconductor aging achieved using the contamination reducing apparatus of FIG. 1.

A liquid electrophotographic (LEP) printer was operated with a shield member 82 like that illustrated in FIG. 1 for 100,000 printing cycles at 10% grayscale, and the dot area was measured at periodic intervals. Dot area is the estimated ink coverage of a tint patch, and is typically derived using an optical densitometer. The LEP printer was also operated for 100,000 printing cycles at 10% grayscale without a shield member, and the dot area was measured at periodic intervals. The change in dot area for the shielded photoconductor surface is illustrated by line 150 in the graph of FIG. 3, while the change in dot area for the unshielded photoconductor surface is illustrated by line 152 in the graph of FIG. 3. A decrease in dot area is indicative of filming of the photoconductor surface. Examining FIG. 3, it can be seen that shielding the photoconductor surface results in a much slower decrease in dot area when compared to the unshielded photoconductor surface.

As described herein, the liquid electrophotograpic printer with the shielded photoconductor surface according to the present invention reduces the amount and rate of accumulation of residual materials and contaminants on the photoconductor surface 22 during operation of the LEP printer. Thus, the rate of deterioration of print quality is decreased and the life span of the photoconductor surface 22 is increased.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An apparatus for reducing contamination of an image transfer surface in an image transfer device, comprising a shield member configured to restrict airflow against the image transfer surface, wherein the shield member covers a portion of the image transfer surface and is spaced from the image transfer surface by a distance sufficient to maintain a partial vapor pressure of an imaging oil adjacent the image transfer surface.

2. The apparatus of claim 1, wherein the shield member is spaced from the image transfer surface by a distance of at least 1 mm.

3. The apparatus of claim 1, wherein the shield member is spaced from the image transfer surface by a distance in the range of 2–5 mm.

4. The apparatus of claim 1, wherein the shield member conforms to the shape of the image transfer surface.

5. The apparatus of claim 1, wherein the shield member covers a portion of the image transfer surface about to be charged to a predetermined electric potential.

6. The apparatus of claim 1, wherein the shield member covers the image transfer surface between a cleaning apparatus and a charging apparatus of the image transfer device.

7. The apparatus of claim 1, wherein the shield member further covers a charging apparatus of the image transfer device.

8. The apparatus of claim 1, wherein the shield member includes a central section positioned over an image producing portion of the image transfer surface and spaced from the image transfer surface by a first distance, and at least one edge portion positioned away from the image producing portion of the image transfer surface and spaced from the image transfer surface by a second distance, wherein the first distance is greater than the second distance.

9. A liquid electrophotographic (LEP) device comprising:

a photoconductor surface for creating an image thereon, the image formed by liquid including imaging oil;

a charging device for charging the photoconductor surface; and a shield positioned adjacent the photoconductor surface for restricting airflow against the photoconductor surface, wherein the shield is positioned from the photoconductor surface by a distance sufficient to maintain a partial vapor pressure of the imaging oil adjacent the photoconductor surface.

10. The liquid electrophotographic device of claim 9, wherein the shield is positioned from the photoconductor surface by a distance of at least 1 mm.

11. The liquid electrophotographic device of claim 9, further comprising:

a cleaning apparatus for cleaning the photoconductor surface;

wherein the shield extends adjacent the photoconductor surface between the cleaning apparatus and the charging device.

12. The liquid electrophotographic device of claim 9, wherein the photoconductor surface is on a drum.

13. The liquid electrophotographic device of claim 9, wherein the photoconductor surface is on a continuous belt.

14. A method of reducing the development of contaminating material on an image transfer surface in an image transfer device of the type using an imaging oil to form an image on the image transfer surface, the image transfer device having a charging device for charging the image transfer surface to a predetermined electric potential, the method comprising:

applying imaging oil to at least a portion of the image transfer surface; and restricting air movement against the portion of the image transfer surface to maintain a partial vapor pressure of an imaging oil adjacent the image transfer surface and thereby inhibit evaporation of the imaging oil on the image transfer surface.

15. The method of claim 14, wherein restricting air movement against the image transfer surface comprises covering the image transfer surface with a shield member.

16. The method of claim 15, wherein covering the image transfer surface with a shield member comprises spacing the shield member from the image transfer surface by a distance of at least 1 mm.

17. The method of claim 15, wherein covering the image transfer surface with a shield member comprises covering the portion of the image transfer surface approaching the charging device.

18. The method of claim 15, wherein covering the image transfer surface with a shield member comprises shaping the shield member to conform to the shape of the image transfer surface.

19. The method of claim 18, further comprising shaping the shield member to conform to the shape of the charging device.

20. An apparatus for reducing contamination of an image transfer surface in an image transfer device, comprising means for restricting airflow against the image transfer surface to maintain a partial vapor pressure of an imaging oil adjacent the image transfer surface and inhibit evaporation of the imaging oil on the image transfer surface.

* * * * *